United States Patent [19]

Rosenthal et al.

[11] 4,450,655

[45] May 29, 1984

[54] VERTICALLY SLOTTED PANEL

[76] Inventors: Michael R. Rosenthal, 6001 SW. 118 St., Miami, Fla. 33156; Ivan Parron, 8013 W. 15th Ave., Hialeah, Fla. 33014

[21] Appl. No.: 411,439

[22] Filed: Aug. 25, 1982

[51] Int. Cl.[3] ..... A47B 5/00

[52] U.S. Cl. ..... 52/36; 248/222.3

[58] Field of Search ..... 52/36, 710; 248/222.2, 248/222.3, 297.2; 211/105.3, 193, 207, 94

[56] References Cited

U.S. PATENT DOCUMENTS

| | | | |
|---|---|---|---|
| 1,661,188 | 3/1928 | Matthews | 248/222.3 |
| 2,271,250 | 1/1942 | Buchholz | 248/222.3 |
| 2,994,413 | 8/1961 | Levy et al. | 53/36 |
| 3,390,500 | 7/1968 | Schumak | 52/710 |
| 3,848,364 | 11/1974 | Costruba | 52/36 |
| 4,161,303 | 7/1979 | Bachland | 211/193 |
| 4,323,034 | 4/1982 | Carlson | 248/297.2 |

FOREIGN PATENT DOCUMENTS

| | | | |
|---|---|---|---|
| 2029197 | 3/1980 | United Kingdom | 248/297.2 |

*Primary Examiner*—John L. Murtagh
*Assistant Examiner*—Andrew Joseph Rudy
*Attorney, Agent, or Firm*—John Cyril Malloy

[57] ABSTRACT

In combination, a vertically slotted panel wherein the vertical slots provide a constricted throat entrance and an internal enlarged pocket to captivatingly nest a keeper which is sized and arranged for limited rotation in the pocket into and out of locking engagement with the side walls of the pocket and which constitutes a clamp member by reason of a screw extending through it and through a force distribution plate sized to overlay the throat margins and from which a support arm extends perpendicularly to the panel so that it is adapted to be tightened into clamping relation in any of a wide variety of locations on the panel by means of screws.

7 Claims, 3 Drawing Figures

VERTICALLY SLOTTED PANEL

FIELD OF THE INVENTION

This invention relates to a wall panel and more particularly to a vertically slotted wall panel in combination with a support arm and clamp assembly for attachment of the arm to the panel.

BACKGROUND OF THE INVENTION

In the past there have been numerous types of wall panels which are affixed to walls in the buildings, for example, and some have been provided with laterally extending geneally T-shaped slots wherein a throat is defined and an interior pocket is defined a holder for an outwardly extending arm provides a transfer of the forces to the lips of the horizontally extending slot. Such a structure has often been utilized in department stores, for example, for displaying articles.

This invention is of an improved panel which is provided with vertical slots and an improved clamp assembly for fastening support arms to the panel at any height which is desired simply by moving the clamp assembly vertically.

SUMMARY OF THE INVENTION

This invention is of a vertically slotted panel and a clamp assembly which is slidably captivated within one of the vertical slots and which connects a support arm to it for supporting various articles, such as shelves.

OBJECTS OF THE INVENTION

It is an object of this invention to provide an improved combination composed of a rigid reinforced vertically slotted wall panel composed of a core of particle board sandwiched between plywood sheets and at least one outwardly extending support arm with an improved clamping mechanism for attaching the arm to the panel.

It is a more particular object of this invention to provide in combination a durable rigid reinforced panel and shelf support and clamp assembly wherein the panel is provided with vertically extending slits of common size opening defining a throat leading into an interiorly disposed pocket having vertical side, front and rear wall sections and which is sized to receive a pair of keeper bars fixed by screws to a force distribution plate to overlay the exterior of the panel and from which there extends a support arm and wherein the same way be readily adjusted vertically to vary the location of the shelf support arm and any articles to be located therein.

It is an overall object of this invention to provide a device of the type described hereinafter which is simple and inexpensive to manufacture, easy to construct and install and which can be readily adjusted to suit the needs of a user and which is as described generally herein.

In accordance with these and other objects which will become apparent hereinafter, the instant invention will be described with reference to the accompanying drawings in which:

DESCRIPTION OF A PREFERRED EMBODIMENT

Figure 1:
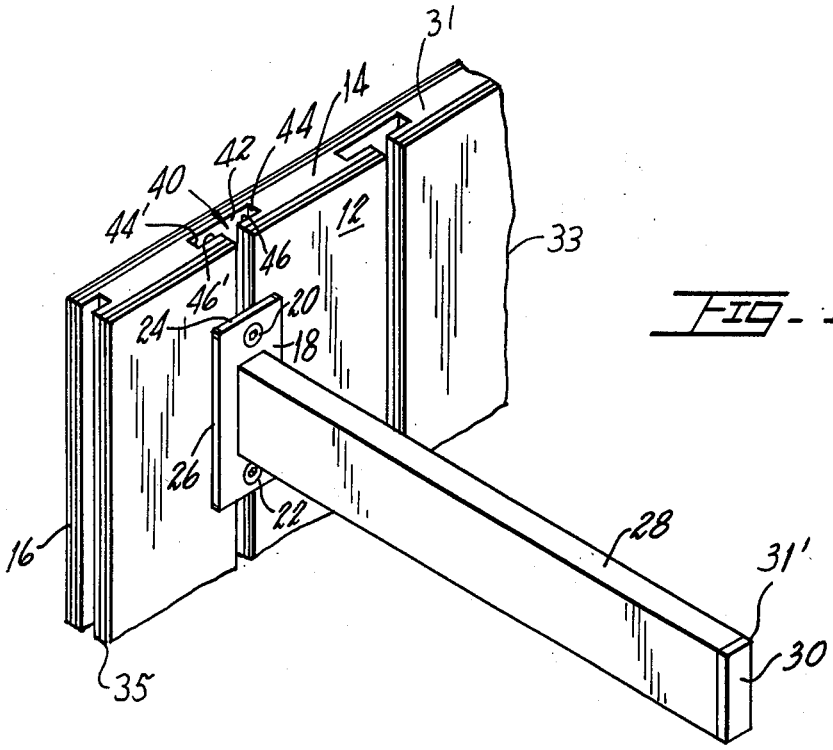
FIG. 1 is a perspective view of the panel and shelf support and clamp assembly.

Referring to the drawings wherein like reference characters designate like or corresponding parts throughout the several views and referring particularly to FIG. 1, the panel is generally designated by the numeral 12. It is seen to be composed of a sandwiched piece of particle board 14 between a front and rear sheet of plywood 15 and 17, the front sheet being covered by an outer skin 19 and, preferably, the rear sheet being covered by a rear skin 2B. The panel has an upper edge or face 31 and a side face 16 as well as an opposite side face 33 which generally designates the same and a lower face 35. It also has a front main face as illustrated and a rear main face to be positioned, for example, on a wall and secured thereto.

Figure 2:
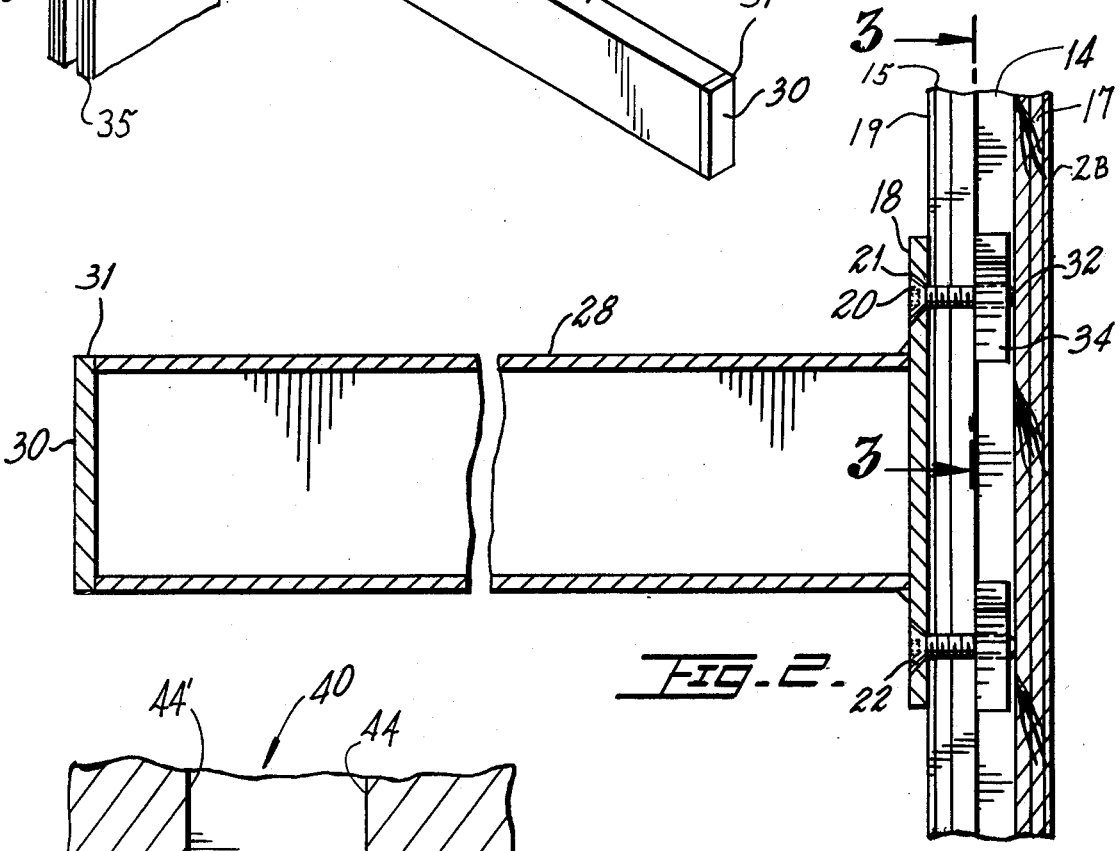
FIG. 2 is a view in cross section illustrating the panel shelf support and clamp assembly.
Figure 3:
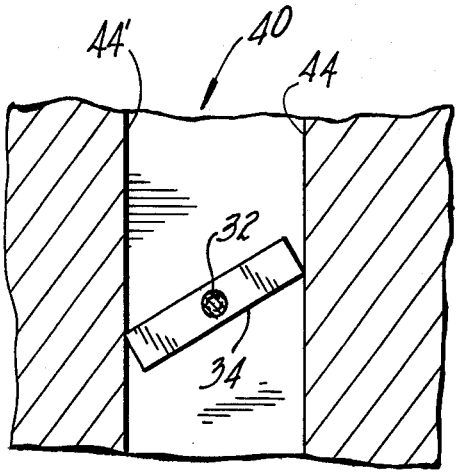
FIG. 3 is a view in cross section of that portion of FIG. 2 designated by the arrowed line 3—3 of FIG. 2 and looking in the direction of the arrows.

It is thus seen that there is provided a rigid reinforced panel, the particle board being sandwiched between and rigidified are reinforced by the plywood and the outer skin providing a decorative surface, for example, a thin veneer of wood or plastic. Extending vertically from the top face completely to the bottom face there are a plurality of spaced vertically extending slits of common size opening in the front face and each of which extends from the front face depthwise perpendicularly of the front face into the particle board and defining a throat leading to an enlarged pocket 40 within the particle board which is bounded by a rear wall 42, opposing side walls 44 and 44' and front wall sections 46 and 46' thus defining by the wall sections lips which are composed of a portion of the thickness of the particle board, the front plywood sheet and the outer skin. In the preferred embodiment, the lateral dimension of the throat is about $\frac{1}{4}$ inch, the depth of the throat, that is the thickness of the lips being $\frac{1}{4}$ inch and the thickness of the pocket, that is the distance between the rear wall and front wall section being about $\frac{1}{4}$ inch, while the lateral dimension of the pocket is substantially greater than and at least three times the thickness of the throat and preferably about $\frac{3}{4}$ inch to about 1 inch. The pocket is of uniform cross section throughout its length between the top edge or surface and the bottom edge or surface of the panel. A shelf support and clamp assembly is provided for use in combination with the panel. As shown, this is composed of an arm 28 which extends perpendicular from the front face of the panel a predetermined distance and which is of a predetermined height and width. The arm 28 has an inner end 18 and an outer end 30. The inner end is enlarged defining a force distribution plate 18 overlaying the panel and more particularly the lips on opposite sides of a slit. The outer end 30 includes a cap 31' disposed thereon to define a distal extremity of arm 28. The plate is of a width greater than the lateral dimension of the throat as indicated by the surface 24 and is of a height greater than the height of the arm as indicated by the edge 26, thus defining an upper zone and a lower zone. Each of these zones has a hole therethrough such as that indicated by the numeral 21 and 22 in FIG. 2 and in each of which there is a headed threaded screw 20 with the head being conically shaped for nested receipt within the countersunk hole as shown. As best seen in FIG. 3, a pair of keeper bars are provided in the pocket for each arm and each of these bars is of a length 34 greater than the distance between the pocket walls 44 and 44' and each of which has a threaded hole therein which accommodates the threaded shank 32 of the screw. Each of the screws extends through the force distribution plate or inner end of the arm and through the throat into threaded engagement with the keeper bars which are sized for receipt within that pocket as shown in FIG. 2. In use, when the screws are withdrawn slightly the arm including the force distribution plate may be adjusted vertically with respect to the vertical slits with the keeper bar remaining captivated within the slit and slidable together with the arm to a preselected position. When in position, the screws are tightened, which causes the keeper bars to rotate into the position shown in FIG. 3 where their surfaces bite into the opposing side walls of the pocket gripping it and thereafter, further tightening of the screws causes a clamping to take place of the longitudinally extending vertical portions of the plate to the lips distributing any vertical forces applied to the arms along the length of both lips in the zone at which the shelf support is attached to the panel.

It is thus seen that there has been provided a support system for a shelf support arm which distributes the load over a substantial zone of the panel and over both lips which are relatively strong by reason of the plywood reinforcing in addition to the particle board and skin and which is readily and easily adjustable vertically to vary the location and arrangement of any displays which might be located on the panel, such as hi-fidilety electronic equipment, books, plants, or the like. The panel is decorative with or without the shelf support and clamp assemblies which can easily be removed from the bottom or the top where small space is provided for ease and withdrawal of the same and which may be covered by a molding or the like if desired.

For purposes of illustration, the screw end 32 is shown projecting from the keeper 34; however, it need not be that long. Indeed, in a preferred embodiment, the screw end is recessed in the keeper bar. Further, the face of the keeper bar confronting the rear wall of the pocket may be notched about the hole through the keeper bar defining outboard feet. Also, an anti-wobble guide means in the form of a sleeve about the screw shank sized for close reception in the throat may be provided. Optionally, the surface of the first distribution plate confronting the panel may have a portion which extends snugly yet slidably into the throat as a positioning guide.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any and all equivalent apparatus and articles.

What is claimed is:

1. In combination, (a) a panel and (b) a shelf support and clamp assembly, comprising:

a panel having a top, bottom and side surfaces and a front main face and a rear main face, and comprising, an outer front skin, a first sheet of plywood adhered to the front skin, and a core of particle board adhered to the first sheet of plywood, and a second rear sheet of plywood adhered to the particle board, and said particle board being sandwiched between the plywood sheets, a plurality of spaced vertical slits of common size opening in the front face and extending from the top surface to the bottom surface, each of said slits defining a throat extending perpendicularly from the front face into the particle board and through the outer front skin and first sheet of plywood, said throat being of predetermined lateral dimension, said slit defining an enlarged pocket within the particle board extending laterally, perpendicularly to the throat and said pocket being bounded by a rear wall, side walls in opposing relation and a pair of coplanar front wall sections, each section extending from the throat and defining a lip on opposite sides of the throat, each lip being composed of a portion of the particle board, an outer plywood sheet and the outer skin, and said walls being parallel to one another, said side walls being spaced from one another a first predetermined distance and said front wall sections and rear walls being spaced from one another a second predetermined distance, a shelf support and clamp assembly, said clamp assembly including, an arm having an inner end and an outer end, said arm being of a predetermined length and height, said inner end being enlarged and defining a force distributing plate of predetermined height, width and thickness.

said plate width being greater than the lateral dimension of said throat and overlaying the skin on said lips, and said plate being of a height greater than the height of the arm and said plate defining a zone above and below the arm overlaying the throat and lips, a countersunk hole in each plate zone, and a pair of screws, each comprising a threaded shank and head, each of said heads being tapered conically toward the shank and each head being sized to nest in one of said holes in nested relation, with the shank of each screw extending through one of the holes and through the throat and into the pocket when the head of each screw is in the countersunk hole, a pair of keeper bars in the pocket, each of said keeper bars being of a predetermined width less than the second predetermined distance between said rear wall and front wall sections and of a length greater than the distance between the side walls, and each of said keeper bars having a central internally threaded hole sized for and in threaded engagement with the threaded shank of each screw, whereby, when the screw is tightened, the width and thickness of the keeper bar will be turned into locking engagement with the side walls of the pocket and be captivated within the enlarged portion clamping the plate and self support in a preselected position with the shelf support extending generally perpendicular of the front main face of the panel.

2. The combination as set forth in claim 1 wherein the panel includes a rear skin.

3. The combination as set forth in claim 1 wherein the arm outer end includes a cap secured thereto.

4. The combination as set forth in claim 1 wherein the throat is of a dimension of about ¼ inch and the pocket between the side walls is at least three times the lateral dimension of the throat.

5. The combination as set forth in claim 1 wherein the height of the support and the force distribution plate is at least 2 inches to distribute forces exerted upon the outer end of the support over a substantial portion of the lips.

6. The combination as set forth in claim 1 wherein the force distribution panel includes vertical edges and the vertical edges are spaced from one another a distance at least equal to the distance between the side walls of the pocket to transmit forces to the main panel body beyond the lips marginally along each slit.

7. The combination as set forth in claim 1 wherein the width of said arm is less than ⅓ of the height of said arm to rigidify the support and to transmit forces to the panel generally when in clamping engagement therewith.

* * * * *